United States Patent [19]

Ray

[11] Patent Number: 4,707,869

[45] Date of Patent: Nov. 24, 1987

[54] SWIM THROUGH SAFETY DIVISION LINE FOR POOLS

[76] Inventor: O. Eugene Ray, P.O. Box 40302, St. Petersburg, Fla. 33743

[21] Appl. No.: 886,175

[22] Filed: Jul. 16, 1986

[51] Int. Cl.[4] ..... E04H; F04H 3/18

[52] U.S. Cl. ..... 4/505; 4/504; 272/1 B

[58] Field of Search ..... 4/488, 496, 504, 505; D21/236, 237; 441/1, 55, 81; 434/254; 119/29; 272/1 B

[56] References Cited

U.S. PATENT DOCUMENTS

| | | | |
|---|---|---|---|
| 3,323,795 | 12/1964 | Quello | 272/1 B |
| 3,329,425 | 7/1967 | Gieseler | 272/1 B |
| 3,332,166 | 7/1967 | Alexander | 272/1 B |
| 3,794,322 | 2/1974 | Rosekrans, Jr. | 272/1 B |
| 3,878,576 | 4/1975 | Suryderhoud | 272/1 B |
| 3,895,801 | 7/1975 | Baird | 272/1 B |

FOREIGN PATENT DOCUMENTS

| | | | |
|---|---|---|---|
| 1238614 | 7/1960 | France | 272/1 B |

*Primary Examiner*—Henry J. Recla
*Assistant Examiner*—Linda J. Sholl
*Attorney, Agent, or Firm*—Brady, O'Boyle & Gates

[57] ABSTRACT

A swim through safety division line for pools at the slope break between shallow and deep water is disclosed. The division line includes a floating frame held vertically by ballast and having top and bottom bars sufficiently above and below the water surface of the pool to allow swimmers to pass through the frame of the division line without being obstructed as when swimming laps in a pool.

8 Claims, 2 Drawing Figures

SWIM THROUGH SAFETY DIVISION LINE FOR POOLS

BACKGROUND OF THE INVENTION

1. Technical Field

The present invention relates broadly to a safety appliance for swimming pools, and more particularly, to an improved safety division line for pools constructed so that swimmers can pass the safety division line without obstruction therefrom.

2. The Prior Art

An increasing number of States require the provision of a rope with spaced visible floats to extend across swimming pools at the point of the slope break between the shallow and deep ends of the pool. Such floating division lines warn swimmers visually that they are approaching deep water and also provide a means that can be grasped by swimmers, such as children in an emergency situation.

A recognized drawback of conventional safety division lines for pools is that they obstruct swimmers who may be swimming laps back and forth for the length of the pool, and also necessitate swimming under water in order to pass the division line, which in turn necessitates wetting the hair of the swimmer, which is inconvenient particularly to individuals having expensive hairdos.

Ideally, a safety division line for pools should provide the required visible barrier across the pool at the slope break point without offering any obstruction to swimmers who wish to cross the division line or barrier.

Accordingly, it is the objective of the invention to completely satisfy the need for a swimming pool safety division line which will not impede swimmers from crossing the line while swimming the length of the pool and will allow swimmers to swim in a normal manner on the surface of the water while crossing the division line.

Other objects and advantages of the invention will become apparent to those skilled in the art during the course of the following detailed description.

SUMMARY OF THE INVENTION

The present invention is best summarized as a rope equipped with visible floats extending across the width of a swimming pool at the slope break line between shallow and deep water. At its center portion, the floating division line is connected to a floating frame having a pair of floats on its side members and being held vertically in a partially submerged state by ballast in its bottom member. The top of the frame is sufficiently far above the water surface to allow swimmers to swim through the frame while on the surface of the water, and the bottom member of the frame is sufficiently far below the water surface that it cannot interfere with the swimmer's feet or legs. The top member of the frame above the surface of the water also provides a visible portion of the safety division line which can be seen by all users of the pool.

DETAILED DESCRIPTION

Figure 1:
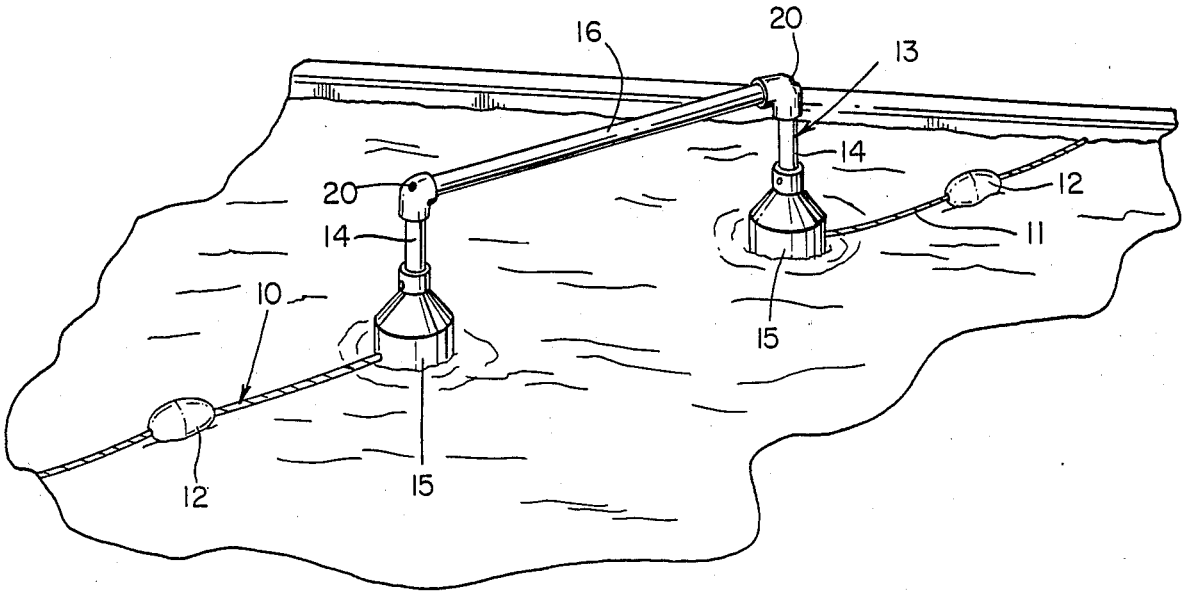
FIG. 1 is a perspective view of a swim through safety division line for pools according to the present invention.

Referring to the drawings in detail wherein like numerals designate like parts, a swimming pool safety division line 10 includes a flexible element 11 or rope extending between the two sides of the pool at the location of the slope break between the shallow and deep ends of the pool. The rope 11 has a number of floats 12 fixed thereto at spaced intervals along its length and these floats are visible to the users of the pool, as required by law in a growing number of States.

To alleviate the problem of the safety division line forming an obstruction for swimmers desiring to swim laps lengthwise of the pool, an open rectangular frame 13, preferably formed of PVC pipe is provided. The side vertical bars 14 of the frame 13 are suitably connected to the division line 11 so that the line is interrupted at the frame 13 and does not extend thereacross.

A pair of floats 15 are suitably attached to the vertical bars 14 a substantial distance below the top horizontal bar 16 of the frame and a greater distance above its bottom horizontal bar 17. Typically, the top bar 16 of the frame will be two feet above the water surface 18 of the swimming pool while the bottom bar 17 is about three feet below the water surface 18. The frame 13 is approximately eighty inches wide between the vertical side bars 14. The above dimensions are not critical, are approximations and may be varied somewhat as found desirable and necessary to meet certain conditions.

Figure 2:
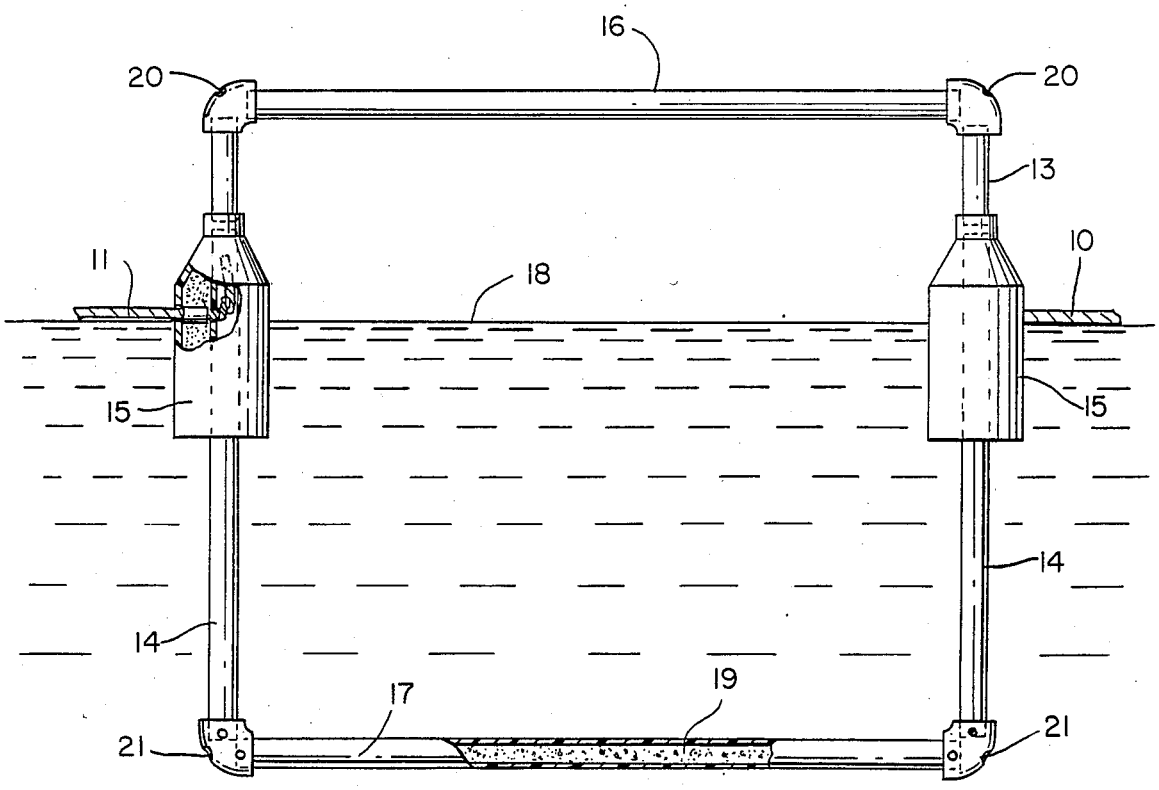
FIG. 2 is a side elevation of the device shown in FIG. 1 on an enlarged scale, partly broken away and partly in section.

As will be seen in FIG. 2, the floats 15 are mounted on the vertical bars 14 coaxially therewith and the ends of the division line rope 11 extend through the respective float and are attached to the vertical bars at substantially the level of the water surface 18. By this construction and arrangement, the floats 15 not only render the frame 13 buoyant but also hold the division line 10 on the water surface 18 to thereby be clearly visible to the swimmers.

In order to maintain the swim through frame 13 normally in a vertical plane while floating in the pool, the bottom bar 17 is filled, or partially filled, with ballast 19, such as concrete or other heavy material. If the frame 13 is tilted from the vertical by users of the swimming pool, it will return automatically to the upright floating position.

The swim through frame 13 is sufficiently wide to allow two swimmers to pass through it without missing a stroke while swimming laps in the pool. The top bar 16 is far enough above the water surface 18 not to obstruct the arms of swimmers, and the bottom bar 17 is far enough below the water surface not to obstruct the legs or feet of swimmers.

The utility of the safety division line in warning swimmers of their approach to deep water is fully preserved while simultaneously eliminating the problem of obstructing swimmers or causing them to swim under water in order to cross the safety division line, as in the prior art.

In some situations, because of the obstruction to swimmers caused by the prior art safety division lines, the lines are taken down and discarded or simply coiled uselessly at one side of the pool, thus completely defeating their main purpose. All of this is eliminated by the present invention.

Preferably, the top bar 16 of the tubular frame 13 has a pair of small vent openings 20 formed therein near the opposite sides of the frame. Water can enter the tubular frame in some instances where the rope 11 is connected to the frame sides 14 and floats 15. This water can enter the lower portion of the frame below the water line of the pool and increase the ballast effect which is beneficial in maintaining the frame upright in the water. However, children and some adults tend to invert the frame 13 in the water and sit on the inverted top bar 16 and, when this takes place, the top of the frame can be filled with water, and without the vent holes 20 an air lock is formed which prevents the water from draining out of the top of the frame when it is righted in the pool and this can render the frame unstable. The provision of the vent holes 20 allows air to enter the frame and thus eliminates the creation of an air lock and even after swimmers have inverted and sat on the bar 16 any water in the top of the frame is free to drain out through the rope holes in the frame sides 14. If desired, a small drain opening or openings 21 may also be formed in the frame 13 anywhere below the floats 15

While not shown on the drawings, in some instances, warning indicia may be placed on one o both sides of the frame top bar 16 including such phrases as "Diving Hazard Below", "Deep Water" and "Stay Off".

The invention is characterized by extreme simplicity and low manufacturing cost. It is entirely practical and solves a recognized problem not heretofore dealt with successfully in the prior art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A swim-through safety division line for pools comprising:

a flexible division line at the water level of the pool extending across the width of the pool between opposite sides of the pool at a slope break of the pool between shallow and deep water, the division line being formed of two parts, each part having a first end attached to opposite sides of the pool and a second end connected to a buoyant frame, said buoyant frame including a top horizontal frame member disposed far above the water level, a bottom horizontal frame member disposed far below the water level and two vertical side frame members extending between the top and bottom horizontal frame members and attached to opposite ends of the top and bottom horizontal frame members to allow the unobstructed passage of swimmers through the frame while swimming lengthwise of the pool, thereby precluding the necessity of swimming under water to pass the division line, and a pair of floats, each float attached coaxially to one of the vertical side frame members, the second ends of the division line extending through said floats and being connected to the opposite vertical side frame members at the level of the pool water surface, whereby the floats not only render the frame buoyant but also hold the division line on the water surface to thereby render the division line visible to swimmers in the pool.

2. A swim through safety division line for pools as defined in claim 1 and the frame being horizontally elongated to enable the simultaneous passage therethrough of more than a single swimmer.

3. A swim through safety division line for pools as defined in claim 1 and the top frame member having at least a vent opening formed therein to prevent the formation of an air lock in the top of the frame being formed of tubing and being hollow.

4. A swim through safety division line for pools as defined in claim 1 and the floats being spaced a lesser distance from the top of the frame than from the bottom thereof.

5. A swim through safety division line for pools as defined in claim 4, and the frame being laterally elongated and approximately rectangular.

6. A swim through safety division line for pools as defined in claim 1 and ballast attached to the bottom frame member to maintain the frame normally upright while floating in the water and causing it to return to an upright position after being tilted.

7. A swim through safety division line for pools as defined in claim 5, and ballast attached to the bottom of the frame member tending to maintain the frame in a vertical plane while floating.

8. A swim through safety division line for pools as defined in claim 1, the frame being constructed of tubing and the bottom frame member being filled at least partially with ballast.

* * * * *